US005092798A

United States Patent [19]

Muench

[11] Patent Number: 5,092,798

[45] Date of Patent: Mar. 3, 1992

[54] ELECTRICAL BUSHING

[75] Inventor: Frank J. Muench, Waukesha, Wis.

[73] Assignee: Cooper Power Systems, Inc., Houston, Tex.

[21] Appl. No.: 693,689

[22] Filed: Apr. 30, 1991

[51] Int. Cl.[5] ..... H01R 4/56

[52] U.S. Cl. ..... 439/805; 439/921; 439/170; 174/152 R

[58] Field of Search ..... 439/805, 181, 183-186, 439/187, 166-177, 934, 921; 174/152 R; 411/383, 389

[56] References Cited

U.S. PATENT DOCUMENTS

| | | | |
|---|---|---|---|
| 1,856,001 | 4/1932 | Spinelli | 174/152 S |
| 2,397,097 | 3/1946 | Forbes et al. | 439/727 |
| 3,622,940 | 11/1971 | Illies | 439/272 |
| 4,353,611 | 10/1982 | Siebens et al. | 439/475 |
| 4,372,718 | 2/1983 | Zaydel | 411/366 |
| 4,611,093 | 9/1986 | Farmer et al. | 174/152 R |
| 4,782,197 | 11/1988 | Stunzi et al. | 174/152 R |
| 4,799,895 | 1/1989 | Borgstrom | 439/183 |
| 4,955,823 | 9/1990 | Luzzi | 439/507 |

FOREIGN PATENT DOCUMENTS

| | | | |
|---|---|---|---|
| 1429937 | 3/1976 | United Kingdom | 174/152 R |

*Primary Examiner*—Gary F. Paumen

*Attorney, Agent, or Firm*—Burns, Doane, Swecker & Mathis

[57] ABSTRACT

An electrical bushing for connection with an electrical apparatus is disclosed. The electrical bushing includes a bushing well which defines an internal cavity, and an electrical conductor having a first end for electrical connection with the electrical apparatus and having a second end extending within the internal cavity. A replaceable stud is electrically connected to the second end of the electrical conductor, and the bushing well further includes a guide flange. The guide flange extends within the internal cavity around the second end of the electrical conductor such that it is spaced from the second end, and guides the stud into connection with the second end of the electrical conductor.

12 Claims, 1 Drawing Sheet

ELECTRICAL BUSHING

BACKGROUND OF THE INVENTION

1. Field of the Invention

The present invention relates to bushings and more particularly to electrical bushings for connection with electrical apparatuses.

2. Description of the Prior Art

Various electrical bushings which include replaceable studs are known in the prior art for connection to electrical apparatuses. For example, U.S. Pat. No. 4,353,611 to Siebens et al. discloses a bushing well 42, a receptacle 41 in the bushing well 42, an electrical contact element 40 which is molded into the bushing well 42 and which includes an internally threaded hole 54, and a threaded rod 60 which threads into the hole 54. The rod 60 includes a wrenching socket 74 which extends therethrough, and an unthreaded extension 70 which jams against a portion 76 of the hole 54 to lock the element 40 and the rod 60 together.

U.S. Pat. No. 4,611,093 to Farmer et al. discloses an electrical bushing 10 which includes a bushing body 14 having a cavity 22 therein and a boss 24 projecting into the cavity 22. An electrical conductor 30 is located within the bushing body 14, has an upper end adjacent to and extending from an upper wall of the boss 24, and includes a threaded bore 34 therein. A replaceable stud 36 is also disclosed which includes a first threaded shank 38 threaded into the bore 34, a second threaded shank 40 opposite the first shank 38, and a flange 42 formed between the first and second shanks 38, 40 such that the flange 42 engages the upper wall of the boss 24 and the upper end of the conductor 30. The stud 36 is designed such that the diameter of the shank 38 is larger than the diameter of the shank 40, so that the shank 40 will break before the shank 38 to ensure removability of the stud 36 from the bore 34 after breakage of the stud 36.

Further, U.S. Pat. No. 4,782,197 to Stunzi et al. discloses an electrical bushing well 10 which includes a bushing 12 defining a bushing cavity in which a reentrant boss 24 is located. An electrical conductor 28, which includes a threaded bore 35, is molded into the bushing 12 such that a radially extending flange 34 of the conductor 28 overlies a shoulder portion of the reentrant boss 24. A replaceable stud 36 includes first and second threaded shanks 38, 40 and a central flange portion 42. In use, the second threaded shank 40 of the stud 36 is threaded into the bore 35 such that the central flange portion 42 is seated on the radially extending flange 34.

All three of the patents discussed above disclose bushings which include replaceable studs. Replaceable studs are known in the prior art as useful to prevent the expensive changing of an entire bushing when a conductive connector of the bushing breaks, since a replaceable stud can be designed to break before other parts of a bushing. However, each of the above patents has the disadvantage, among others, that it is relatively difficult for a person to reach into the cavity in the bushing well and correctly thread a replaceable stud into the conductor of the bushing. The cavities are generally designed to be relatively narrow and relatively deep, and may often be located in hard-to-reach places, thereby further compounding the problem. Incorrect threading can lead to the destruction of the leading threads of both a replaceable stud and a conductor of a bushing, which is both expensive, and costly in terms of the down-time required for replacement of a bushing.

Other electrical connections are known which include some type of connecting insert. For example, U.S. Pat. No. 4,799,895 to Borgstrom discloses, in FIGS. 6–10, a bushing 12, and a contact extender 290 which includes both an externally threaded stud 292 and an internally threaded recess 296, wherein the stud 292 is threaded into a conductor 62 in the bushing 12. Also, U.S. Pat. No. 4,955,823 to Luzzi discloses, in FIGS. 5 and 6, a bushing 20, and a contact extender 290 which includes both a male threaded portion 292 and a female threaded portion 296, wherein the male threaded portion 292 is threaded into a conductor of the bushing 20.

Further, U.S. Pat. No. 3,622,940 to Illies discloses, in FIG. 2, a connector assembly for an electrical apparatus which includes a shank portion 18 of a jack body, and a connector rod 17 embedded in the shank portion 18. A socket 16 has a shank 16*a* threaded into an internally threaded sleeve 17*a* which is connected to the connector rod 17 and is embedded in the shank portion 18.

These latter three patents, however, present the same disadvantage, among others, that the first three patents presented. The contact extenders of both of these patents would be susceptible to accidental cross-threading when the contact extenders are threaded into their respective bushings.

Other connectors are known which involve the threading of a female part onto a male part, instead of, or in addition to, the threading of a male part into a female part. For example, U.S. Pat. No. 1,856,001 to Spinelli discloses a spark plug which includes a center electrode 15 having male threads on a portion 17*a* thereof, a bushing 12 surrounding the portion 17*a*, and a sleeve 18. The sleeve 18 includes a male threaded terminal 18′ on one end thereof, and a male and female threaded portion on an opposite end thereof which is threaded to the portion 17*a* and the bushing 12. A polygonal nut 18*b* is situated between the ends of the sleeve 18 for manipulation by a wrench.

Also, U.S. Pat. No. 2,397,097 to Forbes et al. discloses a separable connector bushing for an electrical apparatus. The bushing includes an insulating tubular member 1, and a stud 17 which is held in the member 1 and which includes a male screw-threaded end 19. A retainer nut 23 is internally threaded at 24 for threading to the end 19, and is externally threaded at 28.

These last two patents are also susceptible to cross-threading, among other disadvantages. Even though the devices of these patents involve the threading of a female part onto a male part, they are still subject to the possibility of cross-threading and its attendant disadvantages.

OBJECTS AND SUMMARY OF THE INVENTION

In view of the above, it is an object of the present invention to provide an electrical bushing which is readily connectable with electrical apparatuses.

A further object of the present invention is to provide an electrical bushing which is designed to break first at a removable and replaceable part thereof.

It is a further object of the present invention to provide an electrical bushing which substantially reduces the possibility of misalignment or cross-threading of a removable and replaceable part of the bushing during assembly of the part to the bushing.

It is a further object of the present invention to provide an electrical bushing which includes a stud which, if it breaks, will break in such a manner that the stud is removable from the bushing and is therefore replaceable.

Another object of the present invention is to provide an electrical bushing which is relatively inexpensive and easy to manufacture.

Yet another object of the present invention is to provide an electrical bushing which needs to be replaced entirely only relatively rarely.

The above objects as well as other objects not specifically enumerated are accomplished by an electrical bushing for connection with an electrical apparatus in accordance with the present invention. An electrical bushing for connection with an electrical apparatus, in accordance with the present invention, includes a bushing well which defines an internal cavity, an electrical conductor having a first end for electrical connection with the electrical apparatus and having a second end extending within the internal cavity, a replaceable stud electrically connected to the second end of the electrical conductor, and a guide flange of the bushing well, wherein the guide flange extends within the internal cavity around the second end of the electrical conductor such that it is spaced from the second end, and wherein the guide flange is for guiding the stud into connection with the second end of the electrical conductor.

The objects of the present invention are also accomplished by an electrical bushing for connection with an electrical apparatus, which includes cavity means for defining an internal cavity, conductor means for conducting electricity between the electrical apparatus and a location within the internal cavity, removable connector means for electrical connection with the conductor means at the location, and guiding means extending within the internal cavity spaced from the conductor means for guiding the removable connector means into connection with the conductor means at the location.

The objects of the present invention are further accomplished by an external bushing for connection to an electrical apparatus, which includes a bushing well, wherein the bushing well includes an internal cavity formed by an internal side wall and an end wall of the bushing well, an electrical conductor extending from a location external of the bushing well, through the end wall, and into the internal cavity, wherein the conductor includes a first male threaded end for electrical connection with the electrical apparatus and a second male threaded end located within the internal cavity spaced from the internal side wall, a removable stud including an inner, female threaded end threaded to the second end of the conductor and an outer, male threaded end for electrical connection with electrical equipment, and a guide flange of the bushing well, wherein the guide flange extends from the end wall around the second end of the conductor such that the guide flange is spaced from the second end and the internal side wall, and wherein the guide flange is for guiding the inner end of the removable stud onto the second end of the conductor to prevent cross-threading therebetween.

BRIEF DESCRIPTION OF THE DRAWINGS

The preferred embodiments of the present invention will be described in greater detail with reference to the accompanying drawings, wherein like members bear like reference numerals and wherein.

DETAILED DESCRIPTION OF THE PREFERRED EMBODIMENTS

Figure 1:
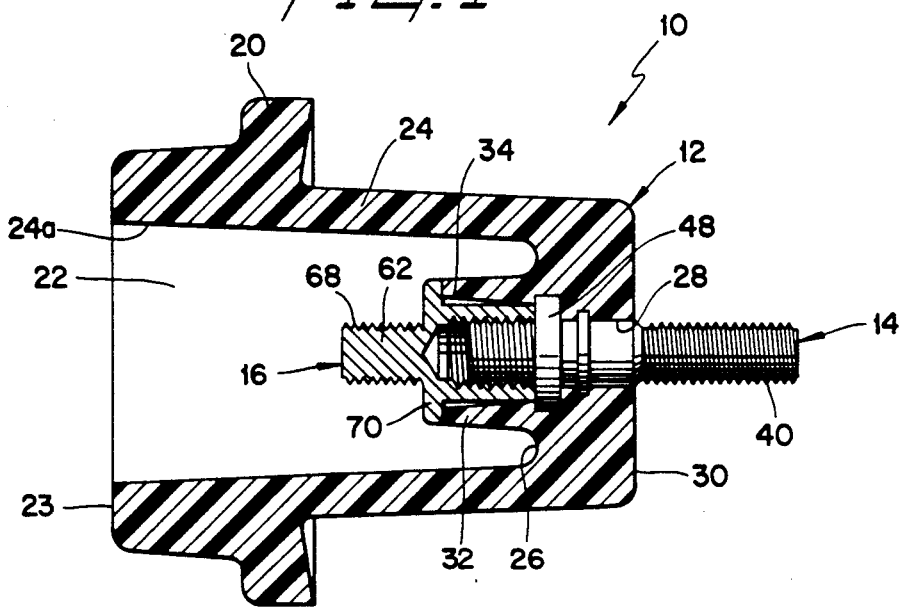
FIG. 1 is a partially sectional side view of an electrical bushing of the present invention.
Figure 2:
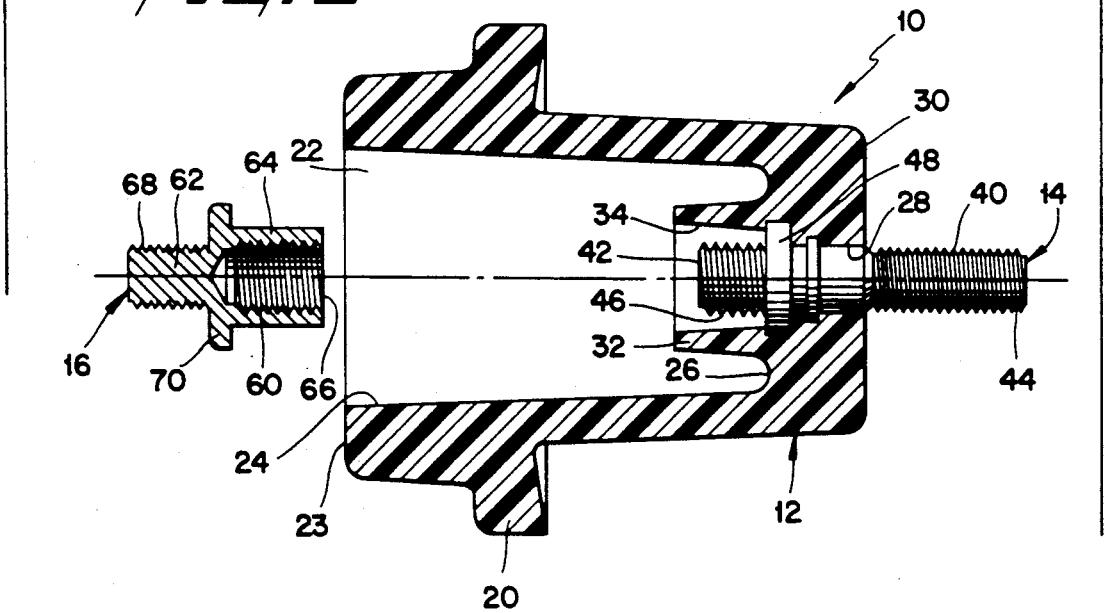
FIG. 2 is a partially sectional side view of the electrical bushing of FIG. 1, with a removable stud of the present invention removed therefrom.

With reference to FIGS. 1 and 2, an electrical bushing 10 includes a bushing well 12, an electrical conductor 14, and a removable and replaceable stud 16.

The bushing well 12 is made of a material which is electrically nonconductive, such as plastic, and is designed to be mounted in a hole in the wall of an electrical apparatus. To this end, the bushing well 12 includes a mounting flange 20 which is designed to extend around an outer lip of the hole in the electrical apparatus. The bushing well 12 includes a frustoconical internal cavity 22 which extends from an outer end 23 of the bushing well 12 and which is defined by a side wall 24 and an end wall 26. A hole 28 extends through the end wall 26 to an inner end 30 of the bushing well 12, and a cylindrical guide flange 32 extends into the internal cavity 2 from the end wall 26 toward the outer end 23 of the bushing well 12. As can be seen from FIGS. 1–2, the guide flange 32 is spaced from an internal surface **24*a* of the side wall 24, and includes an internal surface 34** which is tapered or frustoconical.

As can be seen in FIG. 2, the electrical conductor 14, which is made of metal, is molded into the hole 28 in the bushing well 12 such that a first end 40 of the electrical conductor 14 extends from the outer end 30 of the bushing well 12 externally of the bushing well 12, and such that a second end 42 of the electrical conductor 14 is located within the internal cavity 22. The first end 40 of the electrical conductor 14 includes a male threaded portion 44 for electrical connection to the electrical apparatus to which the electrical bushing 10 is mounted. The second end 42 of the electrical conductor 14 also includes a male threaded portion 46, for electrical connection with the removable stud 16, as will be explained hereinbelow.

As can be seen, the male threaded portion 46 is spaced radially from the guide flange 32, and extends into the internal cavity 22 from the end wall 26 toward the outer end 23 of the bushing well 12. The guide flange 32, as can be seen, extends further into the internal cavity 22 than the male threaded portion 46. The second end 42 of the electrical conductor 14 also includes a bottoming flange 48, whose function will be explained hereinbelow.

The removable and replaceable stud 16 is made of metal and includes an inner end 60 and an outer end 62. The inner end 60 of the stud 16 includes a hollow cylindrical portion 64 which has a female threaded portion 66 therein for threaded connection with the male threaded portion 46 of the electrical conductor 14. The outer end of the stud 16 is cylindrical and includes a male threaded portion 68 thereon for electrical connection to electrical equipment (not shown). Located between the inner and outer ends 60, 62 of the stud 16 is a wrenching flange 70. The wrenching flange 70 allows tightening or loosening of the stud 16 on the male threaded portion 46 of the electrical conductor 14, and can include wrenching flats or some other wrenching surface on a periphery thereof, or can include a number of holes extending therethrough for wrenching.

At an electrical installation the bushing well 12 is mounted within a hole of a fixed electrical apparatus (not shown) such that the mounting flange 20 seats around a lip of the hole. The removable stud 16 has been previously threaded onto the electrical conductor 1 such that the cylindrical portion 64 contacts the bottoming flange 48 of the electrical conductor 14 to improve electrical connection between the stud 16 and the conductor 14. The electrical conductor 14 has been threaded into engagement with a component of the electrical apparatus such that it is in electrical connection therewith.

Thereafter, authorized personnel will connect other electrical equipment (not shown) to the bushing well 12 by threading a component of that other equipment to the male threaded portion 68 of the stud 16, thereby making electrical connection therewith. Often, the process of making such connection involves the placement of relatively large transverse forces on the stud. It is also often the case that various pieces of electrical equipment will be connected and disconnected from the stud 16 repeatedly, thereby multiplying the occurrence of undesired transverse force being placed on the stud 16. Such transverse forces pose a risk that the electrical conductor 14 will become damaged or broken, which would require a costly and time-consuming replacement of the entire bushing 10.

Accordingly, the stud 16 is designed such that the outer end 62 of the stud 16 will break before the male threaded portion 46 of the electrical conductor 14 will break, since the outer end 62 of the stud 16 has an outer diameter which is smaller than an outer diameter of the male threaded portion 46 of the electrical conductor 14. The stud 16 is also designed such that an outer diameter of the outer end 62 of the stud 16 is smaller than an outer diameter of the inner end 60 of the stud 16. Thus, if a large enough transverse force is applied to the stud 16 and the conductor 14, the outer end 62 of the stud 16 will break, not the inner end 60 of the stud 16 or the male threaded portion 46 of the electrical conductor 14.

The broken stud can then be removed by placing a wrench on the wrenching flange 70 of the stud 16 and unthreading the stud 16 from around the male threaded portion 46 of the electrical conductor 14. A new stud 16 can then be threaded onto the electrical conductor 46 by threading the female threaded portion 66 of the stud 16 onto the male threaded portion 46 of the electrical conductor 14 until the cylindrical portion 64 of the stud 16 bottoms out on and contacts the bottoming flange 48.

As stated above, the guide flange 32 extends around the male threaded portion 46 of the conductor 14, is spaced therefrom, and extends into the internal cavity 22 further than the male threaded portion 46. Accordingly, as the replacement stud 16 is moved to a position where it can begin to be threaded onto the male threaded portion 46, it encounters the guide flange 32. Accordingly, the cylindrical portion 64 of the replacement stud 16 is guided by the guide flange 32 toward the male threaded portion 46 in a generally correct alignment and orientation for threading, so that the possibility that the stud 16 will be accidentally cross-threaded onto the conductor 14 is minimized.

The guide flange 32 therefore presents an important advantage, among others, in that it minimizes the risk of cross-threading, even in cases where the electrical bushing 10 is in a location that is difficult for authorized personnel to reach, such as a very low or very high location. Such locations have heretofore made it particularly difficult for personnel to avoid such cross-threading when installing the studs.

As observed earlier, cross-threading of the stud 16 is highly undesirable since it can result in damage to the male threaded portion 46 of the electrical conductor 14, and thereby necessitate replacement of the bushing 10.

It is to be understood that various changes may be made to the present invention, and advantages obtained therefrom. For example, the guide flange 32 is disclosed as being spaced from the internal surface 24*a* of the bushing well 12, but it may be formed as part of the internal surface 24*a*. Also, the bushing well 12 is disclosed as being composed of plastic, but other suitable materials which are relatively electrically insulative could be used. Further, the electrical conductor 14 and the stud 16 may be advantageously formed from almost any suitable conductive material.

If desired, the electrical bushing 10 may be alternatively designed with a cylindrical portion including a female threaded portion on the second end of the electrical conductor 14, with a male threaded portion on the inner end of the stud 16, and with a cylindrical guide flange also on the inner end of the stud 16 spaced from and surrounding the male threaded portion of the stud. The guide flange would extend further from the wrenching flange of the stud 16 than would the male threaded portion, and thus the guide flange would first contact the cylindrical portion of the electrical conductor 14 to guide the stud 16 onto the electrical conductor 14 when the stud was being threaded onto the electrical conductor 14.

The principles, a preferred embodiment, and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

I claim:

1. An electrical bushing for connection with an electrical apparatus, comprising:

a bushing well defining an internal cavity which is closed at one end thereof by an end wall of said bushing well;

an electrical conductor mounted in said end wall, said conductor having a first end for electrical connection with the electrical apparatus and a second end extending within said internal cavity;

a removable stud threadably connected to said second end of said electrical conductor; and said bushing well including means for minimizing the possibility of cross-threading when said removable stud is attached to said second end, comprising a guide flange extending within said internal cavity around said second end of said electrical conductor and spaced radially from said second end for guiding a portion of said stud between said second end and said guide flange and into connection with said second end of said electrical conductor.

2. An electrical bushing as claimed in claim 1, wherein said bushing well includes a side wall extending from said end wall, said guide flange being spaced from said side wall.

3. An electrical bushing as claimed in claim 1, wherein an inner surface of said guide flange is tapered toward said end wall.

4. An electrical bushing as claimed in claim 1, wherein said guide flange extends further into said internal cavity than said second end of said electrical conductor.

5. An electrical bushing as claimed in claim 1, wherein said first and second ends of said electrical conductor are male threaded ends.

6. An electrical bushing as claimed in claim 1, wherein said second end of said electrical conductor is a male threaded end, and wherein said removable stud includes an inner, female threaded end threaded to said male threaded end of said electrical conductor, and an outer, male threaded end for electrical connection to electrical equipment.

7. An electrical bushing as claimed in claim 6, wherein said removable stud further includes a wrenching flange located between said inner and outer ends of said stud for allowing removal of said stud from said internal cavity with a wrench.

8. An electrical bushing as claimed in claim 6, wherein an outer diameter of said inner end of said removable stud is greater than a outer diameter of said outer end of said removable stud.

9. An electrical bushing as claimed in claim 6, wherein an outer diameter of said outer end of said removable stud is smaller than an outer diameter of said male threaded end of said electrical conductor.

10. An electrical bushing as claimed in claim 6, wherein said guide flange extends further into said internal cavity than said second end of said electrical conductor, such that said guide flange pre-guides said female threaded inner end onto said male threaded second end in a limited angular orientation to restrict cross-threading of said threaded ends.

11. An electrical bushing as claimed in claim 1, wherein said electrical conductor includes a bottoming flange adjacent said second end, and wherein an end of said stud is in contact with said bottoming flange when said stud and said electrical contactor are fully connected, to improve the electrical connection between said stud and said electrical conductor.

12. An electrical bushing for connection with an electrical apparatus, comprising:

a bushing well defining an internal cavity which is closed at one end thereof by an end wall of said bushing well;

an electrical conductor mounted in said end wall, said conductor having a first end for electrical connection with the electrical apparatus and a second, male threaded end extending within said internal cavity;

a removable stud including an outer male threaded end for electrical connection to electrical equipment and an inner, female threaded end threadably connected to said male threaded end of said electrical conductor; and said bushing well including means for minimizing the possibility of cross-threading when said removable stud is attached to said male threaded end, comprising a guide flange extending within said internal cavity around said male threaded end of said electrical conductor and spaced radially from said male threaded end for guiding said stud into connection with said male threaded end of said electrical conductor, wherein said guide flange extends further into said internal cavity than said male threaded end of said electrical conductor, and wherein an outer diameter of said outer end of said removable stud is smaller than an outer diameter of said male threaded end of said electrical conductor.

* * * * *